US006702866B2

(12) United States Patent
Kamboj

(10) Patent No.: US 6,702,866 B2
(45) Date of Patent: Mar. 9, 2004

(54) HOMOGENEOUS FIXED ABRASIVE POLISHING PAD

(75) Inventor: Sumant Kamboj, Mandeville, LA (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 10/193,753

(22) Filed: Jul. 11, 2002

(65) Prior Publication Data

US 2003/0126801 A1 Jul. 10, 2003

Related U.S. Application Data

(60) Provisional application No. 60/347,491, filed on Jan. 10, 2002.

(51) Int. Cl.[7] ..... B24D 3/00; B24D 11/00

(52) U.S. Cl. ..... 51/298; 51/307; 51/309; 451/526; 451/527

(58) Field of Search ..... 51/298, 307, 308, 51/309; 451/526, 527

(56) References Cited

U.S. PATENT DOCUMENTS

| | | | | |
|---|---|---|---|---|
| 5,104,421 | A | 4/1992 | Takizawa et al. | |
| 5,342,419 | A | 8/1994 | Hibbard | |
| 5,584,146 | A * | 12/1996 | Shamouillan et al. | 51/293 |
| 5,713,968 | A | 2/1998 | Fruitman et al. | |
| 5,900,164 | A | 5/1999 | Budinger et al. | |
| 5,919,082 | A | 7/1999 | Walker et al. | |
| 5,958,794 | A | 9/1999 | Bruxvoort et al. | |
| 5,972,792 | A | 10/1999 | Hudson | |
| 6,007,407 | A | 12/1999 | Rutherford et al. | |
| 6,039,631 | A | 3/2000 | Sato et al. | |
| 6,039,633 | A | 3/2000 | Chopra | |
| 6,099,394 | A | 8/2000 | James et al. | |
| 6,117,000 | A | 9/2000 | Anjur et al. | |
| 6,126,532 | A | 10/2000 | Sevilla et al. | |
| 6,346,202 | B1 | 2/2002 | Molnar | |
| 6,537,134 | B2 * | 3/2003 | Newell | 451/6 |
| 2002/0072296 | A1 * | 6/2002 | Mullenburg et al. | 451/5 |

OTHER PUBLICATIONS

Article—"Chemical Mechanical Planarization by a Rotary, Fixed–Abrasive Process", Ebara Technologies, Inc., SEMICON West 2000, (no month).

* cited by examiner

*Primary Examiner*—Michael Marcheschi
(74) *Attorney, Agent, or Firm*—Ingrassia Fisher & Lorenz P.C.

(57) ABSTRACT

A homogeneous fixed abrasive polishing article, or pad, including a matrix of a cured resin coated soft filler material having at least one working surface and an abrasive uniformly distributed throughout the filler material. A method for manufacturing the polishing pad includes the steps of mixing a binder, solvent and filler material together; drying the resin coated filler material; grinding the resin coated filler material; sieving the resin coated filler material; mixing an abrasive material with the resin coated filler material; sieving the abrasive material and the resin coated filler material thereby creating a powder material; transferring the powder material to a mold to form a working surface for the polishing pad; compressing the powder material; and curing the powder material. Alternatively, the abrasive may be mixed with the binder, solvent and filler material in the first step instead of later in the process.

29 Claims, 3 Drawing Sheets

HOMOGENEOUS FIXED ABRASIVE POLISHING PAD

CROSS REFERENCE TO RELATED APPLICATION

This application claims the benefit of U.S. Provisional Application No. 60/347,491, filed Jan. 10, 2002, the entire contents of which are hereby incorporated by reference.

TECHNICAL FIELD

The present invention relates, generally, to the chemical mechanical planarization of a workpiece and, more particularly, to the chemical mechanical planarization of a workpiece using a homogeneous fixed abrasive polishing pad.

BACKGROUND OF THE INVENTION

A chemical mechanical planarization (CMP) process is widely used in the manufacturing process of VLSI devices with sub-micron geometries. The CMP process reduces the step height between the high and low features on the surface of a semiconductor wafer allowing subsequent lithography steps to operate on a planar surface. This allows for multiple layers of deposition on the wafer and allows for the creation of semiconductor devices with greater feature densities.

More particularly, a resinous polishing pad having a cellular structure is traditionally employed in conjunction with slurry, for example, a water-based slurry comprising colloidal silica particles. When pressure is applied between the polishing pad and the workpiece (e.g., silicon wafer) being polished, mechanical stresses are concentrated on the exposed edges of the adjoining cells in the cellular pad. Abrasive particles within the slurry concentrated on these edges tend to create zones of localized stress at the workpiece in the vicinity of the exposed cell edges. This localized pressure creates mechanical strain on the chemical bonds comprising the surface being polished, rendering the chemical bonds more susceptible to chemical attack or corrosion (e.g., stress corrosion). Consequently, microscopic regions are removed from the surface being polished, enhancing planarity of the polished surface. See for example, Arai et al., U.S. Pat. No. 5,099,614, issued March 1992; Karlsrud, U.S. Pat. No. 5,498,196, issued March 1996; Arai et al., U.S. Pat. No. 5,329,732, issued July 1994; and Karlsrud et al., U.S. Pat. No. 5,498,199, issued March 1996, for further discussion of presently known lapping and planarization techniques. By this reference, the entire disclosures of the foregoing patents are hereby incorporated by reference herein.

As the size of microelectronic structures used in integrated circuits decreases to sub-half-micron levels, and as the number of microelectronic structures on current and future generation integrated circuits increases, the degree of planarity required increases dramatically. The high degree of accuracy of current lithographic techniques for smaller devices requires increasingly flatter surfaces. However, presently known polishing techniques are believed to be inadequate to produce the degree of local planarity and global uniformity across the relatively large surfaces of silicon wafers used in integrated circuits, particularly for future generations.

A typical CMP process used to manufacture VLSI devices involves polishing built-up layers of dielectrics and conductors used to form integrated chips on a wafer. The wafer is pressed against a compliant polishing pad in the presence of a slurry containing suspended abrasive particles. High features on the surface of the wafer cause high-pressure areas against the polishing pad that result in an increased removal rate in the area of the high feature. In a similar manner, low features cause low-pressure areas against the polishing pad that result in a decreased removal rate in the area of the low features. The combination of increased removal at areas having high features and decreased removal at areas having low features improves the planarity of the surface of the wafer.

However, the compliant nature of conventional polymeric polishing pads allows the polishing pad to also remove material, albeit at a slower rate, in areas having low features. In addition, the abrasives in the slurry are able to collect in the low feature areas undesirably increasing the removal rate in the low feature areas. Even though the removal rates from the low areas is lower than the removal rates in the higher areas, the difference in the removal rates, or selectivity to topography, is not sufficient.

A need therefore exists for a polishing pad that has greater selectivity to topography to improve the planarity of the workpiece during a chemical mechanical planarization process. In addition, a manufacturing method is needed to produce the improved polishing pad.

SUMMARY OF THE INVENTION

These and other aspects of the present invention will become more apparent to those skilled in the art from the following non-limiting detailed description of preferred embodiments of the invention taken with reference to the accompanying figures.

In accordance with an exemplary embodiment of the present invention, a homogeneous fixed abrasive polishing article, or pad, includes a cured resin coated talc matrix having at least one working surface and an abrasive uniformly distributed throughout the cured resin coated talc. In a preferred embodiment, the abrasive comprises ceria.

In accordance with another exemplary embodiment of the of the present invention, a homogeneous fixed abrasive polishing pad includes a filler material having a hardness less than 3 on the Mohs hardness scale. An abrasive is uniformly distributed throughout the filler material and a plurality of conduits is created through the filler material for delivering a fluid through a polishing pad.

In accordance with yet another exemplary embodiment of the present invention, a homogeneous fixed abrasive polishing pad includes a filler material having a hardness less than 3 on the Mohs hardness scale wherein the filler material has at least one substantially planar working surface. An abrasive is uniformly distributed throughout the filler material and a plurality of grooves is created in the working surface for the transportation of fluids over the working surface.

In accordance with yet another exemplary embodiment of the present invention, a method for manufacturing a homogeneous fixed abrasive polishing pad having a working surface is provided. The method includes the steps of mixing a binder, a solvent and a filler material together, wherein the filler material has a hardness less than 3 on the Mohs hardness scale, thereby creating a resin coated filler material. Drying the resin coated filler material. Grinding the resin coated filler material. Sieving the resin coated filler material. Mixing an abrasive material with the resin coated filler material. Sieving the abrasive material and the resin coated filler material thereby creating a powder material.

Transferring the powder material to a mold wherein the mold has at least one substantially planar surface to form a working surface for the polishing pad. Compressing the powder material. Curing the powder material, preferably in an oven. Removing the cured powder material from the mold and preparing the cured powder material for use on a chemical mechanical planarization tool. In a preferred embodiment, conduits through the polishing pad and/or grooves on the working surface of the polishing pad are created. In addition, one or more optically transparent windows or plugs may be formed in the polishing pad. The windows may be of a suitable polymer material for facilitating optical inspection of a workpiece through the transparent window.

In accordance with yet another exemplary embodiment of the present invention, another method for manufacturing a homogeneous fixed abrasive polishing pad having a working surface is provided. The method includes the steps of mixing a binder, a solvent, an abrasive material and a filler material together, wherein the filler material has a hardness less than 3 on the Mohs hardness scale, thereby creating a resin coated abrasive-filler material. Drying the resin coated abrasive-filler material. Grinding the resin coated abrasive-filler material. Sieving the resin coated abrasive-filler material thereby creating a powder material. Transferring the powder material to a mold. Compressing the powder material within the mold. Curing the powder material, preferably by heat. Removing the cured powder material from the mold and preparing the cured powder material for use on a chemical mechanical planarization tool.

BRIEF DESCRIPTION OF THE DRAWING FIGURES

Exemplary embodiments of the present invention will hereafter be described in conjunction with the appended drawing figures, wherein like designations denote like elements, and:

DETAILED DESCRIPTION OF THE INVENTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth.

Figure 1:
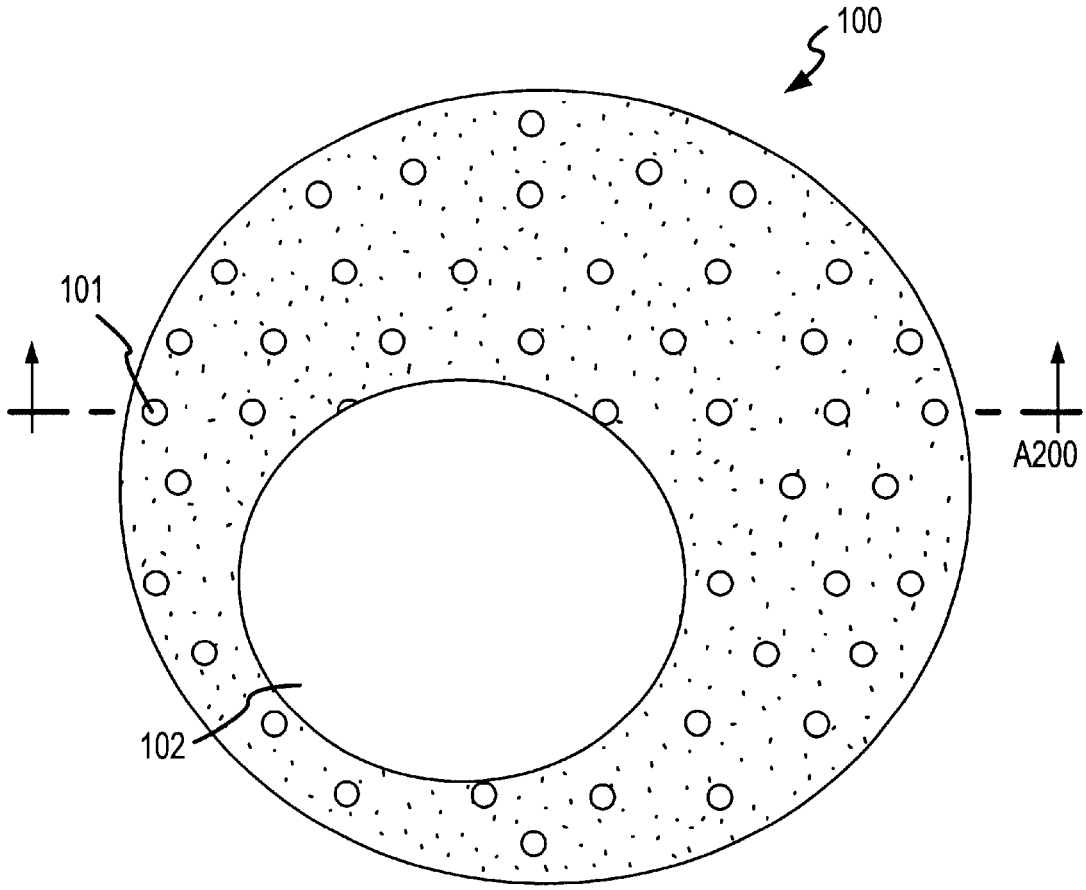
FIG. 1 is a top view of a working surface of a homogeneous fixed abrasive polishing pad with conduits and grooves.
Figure 2:
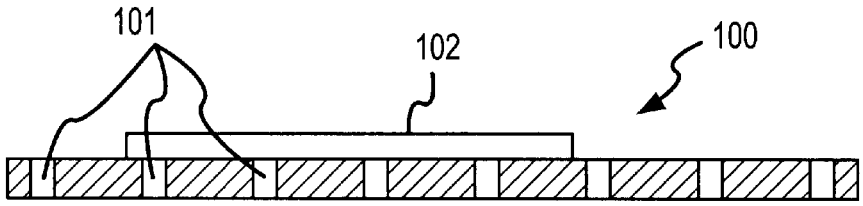
FIG. 2 is a cross-sectional view along arrow A200 in FIG. 1 of the polishing pad.

A top view of a working surface of a homogeneous fixed abrasive polishing pad 100 with conduits 101 and grooves is illustrated in FIG. 1 while a cross-sectional view is illustrated in FIG. 2. In a typical application, the polishing pad 100 will be mounted on a platen (not shown) in a chemical mechanical polishing (CMP) tool (not shown). The CMP tool will advantageously have means, e.g. automated robots, for transporting the wafer 102 to and from the polishing pad 100. The CMP tool will also have means for holding the wafer while the wafer is pressed against the polishing pad 100 and for generating relative motion between the wafer 102 and the polishing pad 100. For convenience, the term "pad" will be used interchangeably with "article" for polishing article 100 throughout this description, although it should be appreciated that the fixed abrasive polishing article of the present invention is useful in applications other than CMP or that utilize CMP pads, and not limited as such.

The wafer 102 is pressed against the working surface of the polishing pad 100 in the presence of a fluid while relative motion between the wafer 100 and the polishing pad 100 is generated. Various combinations of motions for either the wafer 100 and/or the polishing pad 100 are known. For example, the wafer 100 may be rotated or oscillated about its central axis while the polishing pad 100 may be orbited, rotated, vibrated or oscillated in a linear direction. An example of planarizing a wafer 100 by orbiting the polishing pad 100 is disclosed in U.S. Pat. No. 5,554,064, issued Sep. 10, 1996 to Breivogel et al., which is hereby incorporated by reference. While the polishing pad 100 is illustrated in FIGS. 1 and 2 as being disk-shaped, it may also be manufactured to be rectangular or any other shape that may be desired.

The polishing pad 100 of the invention is less compliant than many polishing pads in the prior art. This enhances the contact and removal rate for areas on the wafer 102 having high features while diminishing the contact and removal rate for areas having low features. Enhancing the removal rate in areas having high features and diminishing the removal rate in areas having low features greatly improves the planarity of the wafer 102.

The polishing pad 100 comprises a matrix which substantially comprises a soft friable filler material with a substantially uniform distribution of abrasive material throughout. For example, the soft material may be talc, gypsum, or calcite. The abrasive material may be, for example, ceria, alumina, or silica. In a particularly preferred embodiment, the polishing pad comprises a ceria abrasive uniformly distributed in a cured resin coated talc material.

The matrix material is preferably friable, allowing new abrasive material to be exposed during the planarization process to maintain an acceptable removal rate. Thus, the removal rate of the polishing pad 100 may be maintained while the polishing pad 100 is slowly worn down thereby creating a polishing pad 100 with an extended life. The polishing pad 100 is preferably at least 1 mm in thickness and more preferably about 3 cm thick. A thicker polishing pad 100 will have an increased useable lifetime. The soft friable material preferably has a hardness less than 3 on the Mohs hardness scale. A filler material of this type will have the benefit of reducing scratching or the creation of defects on the working surface of the wafer 102.

A fluid may be introduced between the polishing pad 100 and the working surface of the wafer 102 to enhance the planarization process. A plurality of conduits 101 may be created, preferably by drilling, through the polishing pad 100 to facilitate the transportation of fluids to the wafer-polishing pad interface. Since abrasives are uniformly distributed in the polishing pad 100, the fluid preferably does not have abrasive particles. This advantageously prevents abrasives from the fluid to accumulate in areas on the wafer 102 having low areas. Thus, greater focus of the abrasives in the polishing pad 100 is achieved on the areas of the wafer 102 having high areas.

Grooves may also be formed on the working surface of the polishing pad 100 to facilitate the transportation of one or more fluids across the working surface of the polishing pad 100. The polishing pad 100 may be created with a wide variety of grooves with different characteristics, e.g. width, depth, shape, direction, or concentration. The grooves may be formed during the curing process using a mold or may be formed after the curing process by removing material on the working surface of the polishing pad 100 by cutting or grinding.

Figure 3:
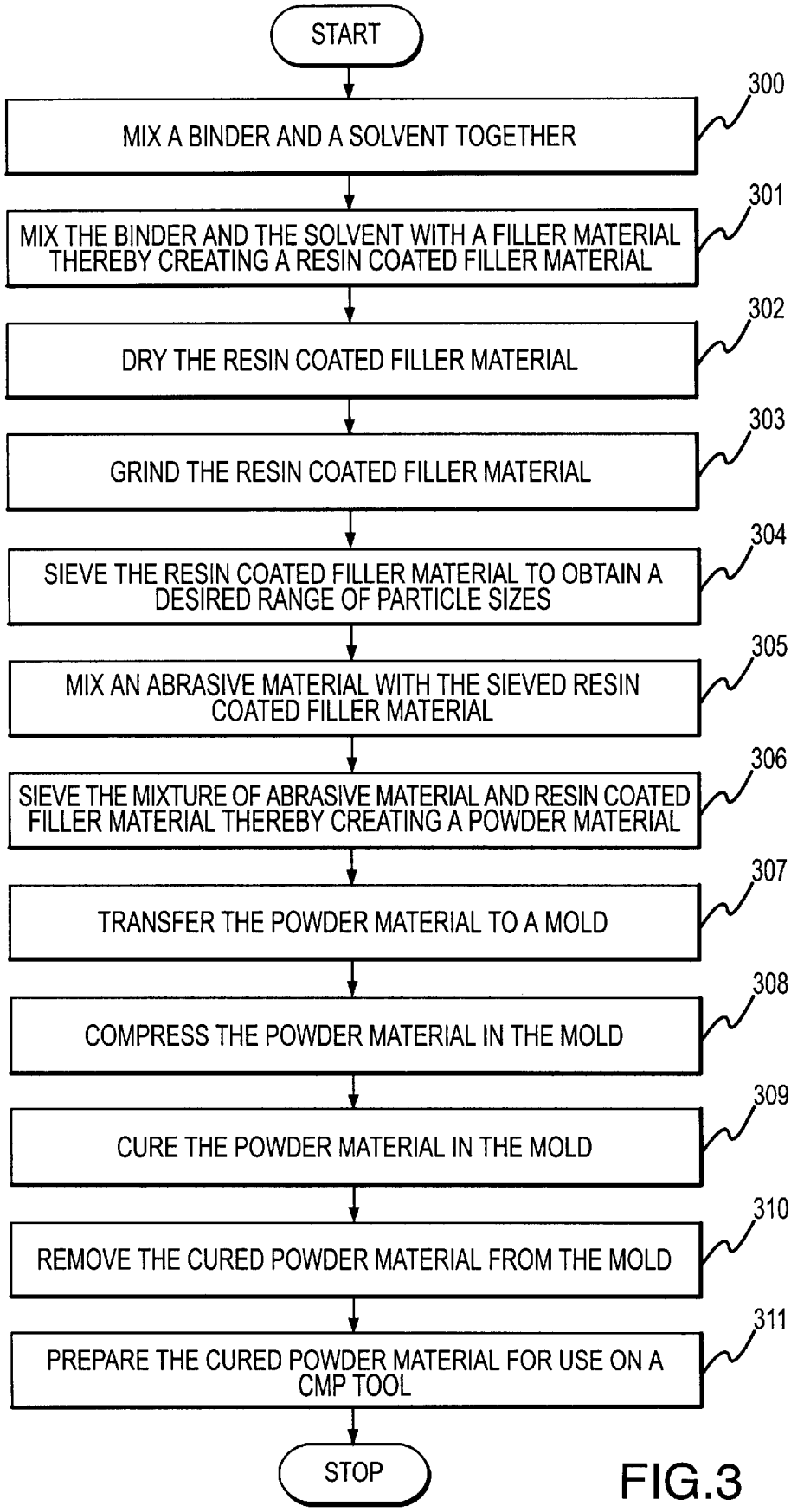
FIG. 3 is a flowchart illustrating a possible manufacturing method of a homogeneous fixed abrasive polishing pad.

A method for producing a polishing pad 100 will now be described with reference to FIG. 3. A filler material, preferably with a hardness less than 3 on the Mohs hardness scale and particle size of between about 50 and 1000 mesh and most preferably between about 200 and 325 mesh is placed in a mixer. The filler material may comprise talc and be sieved by a mesh to obtain the desired particle size.

At Step 300, a binder and solvent are mixed thoroughly together. The binder is preferably a liquid epichlorohydrin based epoxy resin with a curing agent. The epoxy resin may be a Modified Bisphenol or Shell sold under the trade name of EPON ® Resin 813, Shell code 43214. The curing agent may be aromatic Diamine Shell, sold under the trade name EPI-Cure®, Shell code 44612. The amount of resin used is preferably between about 5% and 15% by weight of the filler material and the amount of epoxy used is preferably between about 10% and 30% by weight of the filler material. The solvent may be Acetone and of a sufficient quantity to allow wetting of all the filler material. In a preferred embodiment, the volume of the binder and solvent may be 500 ml for each 650 grams of filler.

At Step 301, the binder and solvent are mixed with the filler material thereby creating a resin coated filler material. The binder and solvent may be slowly poured into the mixer with the filler and slowly, but thoroughly, mixed together. The resin coated filler material will turn achieve a dough like consistency which should be kneaded until no free liquid is visible and the resin coated filler material stops sticking to the mixing bowl.

At Step 302, the resin coated filler material is dried. The drying time may be shortened by spreading the resin coated filler material into a thin layer, thereby exposing more of the surface area of the resin coated filler material. In addition, the resin coated filler material may be crushed or broken into smaller pieces to further enhance the drying process. At 70° F. a small quantity of resin coated filler material, sufficient for a single polishing pad, may be dried in about 24 hours. Excessive drying is preferably avoided as this may make the subsequent grinding process more difficult.

At Step 303, the resin coated filler material is broken into particles having a predetermined range of particle sizes. A grinding mill with high speed rotating blades, or any other known method of breaking a hard material into particles of a desired size may be used to grind the resin coated filler material. At Step 304, the resin coated filler material is sieved to obtain the desired range of particle sizes. In a preferred embodiment, the resin coated filler material is sieved to obtain particle sizes of about 35 to 200 mesh, and most preferably about 100 mesh.

At Step 305, an abrasive material of known mesh size and purity are added to the resin coated filler material. The abrasive may be, for example, ceria with particle sizes ranging from sub-micron to 5 microns. The weight ratio of abrasive to resin coated filler material may be about 0.3 to 0.7. Of course, the abrasive chosen, particle size, and weight ratio to resin coated filler material may be specifically optimized depending on the desired polishing characteristics, e.g. removal rate, defectivity, of the polishing pad and the particular characteristics of the workpieces to be polished.

At Step 306, the mixture of resin coated filler material and abrasive material are sieved together to thoroughly mix and uniformly distribute the abrasive material throughout the resin coated filler material. The sieving process also removes particles that have agglomerated to a larger size and may be repeated to insure a thorough mixing of all the particles. The thoroughly mixed resin coated filler material and abrasive material create a powder material.

At Step 307, the powder material is transferred to a mold of sufficient strength to withstand the later compressing step without excessive warping to ensure the polishing pad has a sufficiently planar working surface. The shape of the mold is preferably in the shape that is desired for the final polishing pad, however other shapes may be used and the final polishing pad worked into its final shape by cutting or grinding. The inner surfaces of the mold are preferably coated with a releasing agent or have release paper covering them to facilitate later removal from the mold. The release agents may be, for example, Ease Release 500 manufactured by Mann Formulated, Inc. In the case where the mold is sized to be filled to the top, the amount of powder material used may be controlled by placing an excess amount of powder material in the mold and then dragging a flat bar across the top of the mold to remove the excess.

In a particularly preferred embodiment, the mold is disk shaped with a fixed top plate and a movable bottom push plate. The top plate and push plate surfaces may have release paper covering them while the circular inner wall may be coated with a releasing agent. In one embodiment, pins may be created in either the top plate or bottom push plate surfaces extending to corresponding receiving apertures in the other plate for creating conduits through the finished polishing pad. Alternatively, the conduits may be drilled into the cured polishing pad. In another embodiment grooves may be formed on the working surface of the polishing pad by having a raised imprint of the desired grooves on either the top plate or the bottom push plate.

At Step 308, the powder material is compressed within the mold. This may be accomplished, for example, by transferring the mold to a hydraulic press. Initial short duration and low down force compressions may be used to allow release of air and uniform compaction of the powder material. As a specific example, four compressions at five tons for 10 seconds may be used. Thereafter longer duration and higher down force compressions may be used to fully compact the powder material. As a specific example, a first compression at 40 tons for 15 minutes may be followed by a second compression at 45 tons for 20 minutes.

The number of total compressions and applied down force and length of time for each compression may be varied to achieve different polishing pad characteristics. These variables may be optimized to achieve the desired polishing quality, polishing pad life, abrasive release characteristics, planarization efficiency, selectivity to topography, micro-scratching, and initial and final removal rate for the particular workpiece being processed.

At Step 309, the powder material in the mold is cured. This may be accomplished, for example, by heating the powder material in an oven. A specific example of heat curing the powder material in an oven will now be given. The oven may be preheated to a temperature between about 100 C. and 200 C. and preferably at about 150 C. The mold may be placed in the oven with, for example, a 20 Kg weight over the push plate of a 300 mm diameter mold to maintain a small amount of compression on the powder material. The mold may be left in the oven for about one hour at which time the oven may be turned off and the mold allowed to sit in oven for an additional two hours as the oven cools. The door of the oven may be opened and the mold allowed to cool for another hour. The mold may be removed from the oven and allowed to cool for another hour outside the oven.

Alternatively, the powder may be heat cured while under the full compression load. In that case the mold may be clamped or bolted together while under load on the hydraulic press, so as to maintain the compression load when the mold is subsequently removed from the press. The compressed assembly may then be heat cured as previously described. Some presses include an integrated heater, in which case the clamps would be unnecessary, and the mold could be heat cured while in the press.

At Step 310, the cured powder material is removed from the mold. This may be accomplished once the cured powder material has cooled to a temperature of about 60 C. Depending on the type of mold used, a push stand or other method may be used to release the cured powder material from the mold.

At Step 311, the cured powder material is prepared for use as a polishing pad for a chemical mechanical polishing tool. If conduits are desired, and were not created during Step 307, they may be formed at this point of the process. However, prior to forming conduits, one side of the pad is preferably prepared for attachment to a polish platen. First, 10 ml of EPON 13 resin may be applied to one side of the cured powder material. The resin may be allowed to dry at about room temperature for about 15 minutes. Once the resin has dried, a 3M adhesive tape may be applied over the resin treated surface. Conduits may then be drilled through the cured powder material if a conduit fluid delivery system is to be used as part of the chemical mechanical planarization process.

Finally, one or more optically transparent windows or plugs may be formed in the polishing pad. The windows may be of a suitable polymer material for facilitating optical inspection of a workpiece from beneath the pad and polish platen through the transparent window. One such suitable polishing pad window is described in pending U.S. patent application Ser. No. 09/587,593, the relevant parts of which are hereby incorporated by reference. The window described in the '593 application is made principally from an ultraviolet light cured polymer that may be cast directly into an aperture in a polishing pad, or pre-cast into windows for subsequent bonding into the pad. Likewise in accordance with the present invention, a window may be cast or bonded directly into a conduit that was formed previously in the pad by either manner described above in reference to step 311. Alternatively a pre-cast window may be mounted within the mold, like the pins described above in reference to step 307, to extend from either the top plate or bottom push plate surfaces to receiving apertures in the other plate. In that case, the pre-cast window may be coated with a suitable adhesive to enhance bonding of the window to the pad material.

The cured powder material is now a polishing pad 100. It may be attached to a rigid platen as part of a chemical mechanical polishing tool for use in planarizing workpieces or, e.g. semiconductor wafers. The new polishing pad 100 may be conditioned using conventional conditioning techniques prior to pressing and planarizing a workpiece against the working surface of the polishing pad 100. Such techniques may include the use of an abrasive, diamond grit coated pad conditioner, or a bristle brush type pad conditioner.

Figure 4:
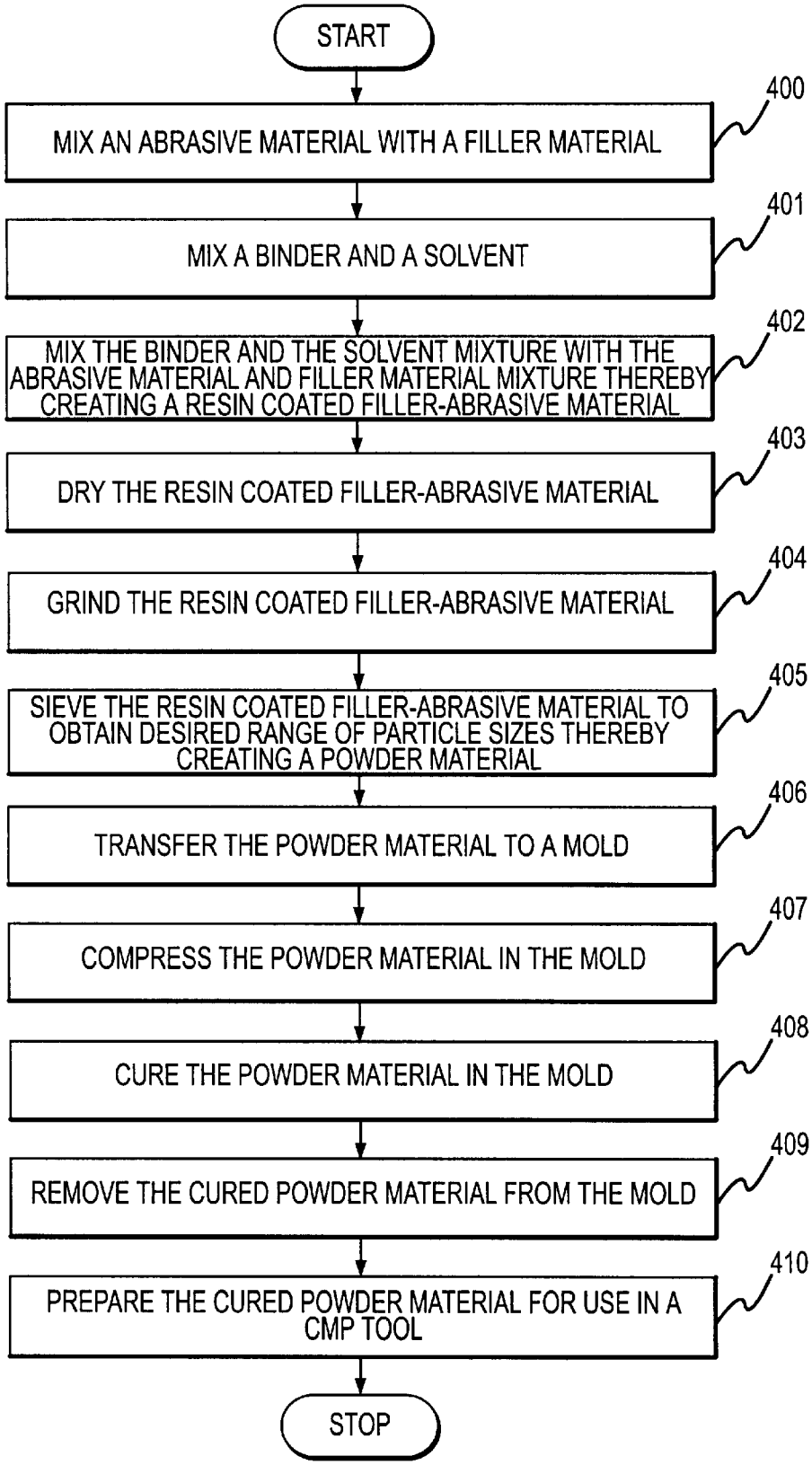
FIG. 4 is a flowchart illustrating a possible manufacturing method of a homogeneous fixed abrasive polishing pad.

Another method for producing a polishing pad 100 will now be described with reference to FIG. 4. This method is similar to the previously described method so only the differences will be specifically addressed. At Step 400, the abrasive particles are added to the filler material and at Step 401 the binder and solvent are mixed together. Adding the abrasive particles earlier in the process allows the abrasive particles to also become resin coated along with the filler material at Step 402. At Step 403, the resin coated filler-abrasive material is dried. At Step 404, the resin coated filler-abrasive material is broken into small particles. At Step 405, sieving the resin coated filler-abrasive material creates a powder material having particles of a desired size. Steps 406–410 may follow the process of the first method as previously described.

Although the subject invention has been described herein in conjunction with the appended drawing figures, it will be appreciated that the scope of the invention is not so limited. In addition, while the method of manufacturing the polishing pad was described in terms of a single polishing pad to simplify the description, larger quantities of materials and mass production methods may be used to produce a plurality of polishing pads at the same time. Various modifications in the arrangement of the components discussed and the steps described herein for the use and manufacture of the invention may be made without departing from the spirit and scope of the invention as set forth in the appended claims.

I claim:

1. An abrasive polishing article, comprising:

a homogenous fixed polishing pad comprising a cured mixture including a non resin-coated abrasive uniformly mixed with a resin-coated talc material.

2. The polishing article of claim 1, wherein the abrasive comprises ceria.

3. The polishing article of claim 1, wherein said polishing pad further comprises an optically transparent portion.

4. An abrasive polishing article, comprising:

a) a homogenous fixed polishing pad comprising a cured mixture including a non resin-coated abrasive uniformly mixed with a resin-coated mineral filler material having a hardness less than 3 on the Mohs hardness scale, the polishing pad having a working surface; and b) a plurality of conduits through the polishing pad adapted for delivering a fluid to the working surface.

5. The polishing article of claim 4, wherein the filler material comprises talc.

6. The polishing article of claim 4, wherein the abrasive comprises ceria.

7. The polishing article of claim 4, wherein said polishing pad further comprises at least one optically transparent window adapted to allow for transmission of light through the polishing pad.

8. An abrasive polishing article, comprising:

a homogenous fixed polishing pad comprising a cured mixture including a non resin-coated abrasive uniformly mixed with a resin-coated mineral filler material having a hardness less than 3 on the Mohs hardness scale, the polishing pad having a working surface and a plurality of grooves created in the working surface for the transportation of fluids over the working surface.

9. The polishing article of claim 8, wherein the filler material comprises talc.

10. The polishing article of claim 8, wherein the abrasive comprises ceria.

11. The polishing article of claim 8, wherein the polishing pad further comprises an optically transparent window portion.

12. A method for manufacturing a homogenous fixed abrasive polishing article having a working surface, comprising the steps of:

a) mixing a resinous binder, a solvent and a filler material together, wherein the filler material has a hardness less than 3 on the Mohs hardness scale, thereby creating a resin coated filler material;

b) drying the resin coated filler material;

c) grinding the resin coated filler material;

d) sieving the resin coated filler material;

e) mixing an abrasive material with the resin coated filler material;

f) sieving the abrasive material and the resin coated filler material thereby creating a powder material;

g) transferring the powder material to a mold wherein the mold has at least one substantially planar surface to form a working surface for the polishing article;

h) compressing the powder material; and i) curing the powder material.

13. The method of claim 12, further comprising the steps of:

j) removing the cured powder material from the mold; and k) applying an adhesive to a portion of the cured powder material for adhering the polishing article to a polishing platen.

14. The method of claim 12, wherein the filler material comprises talc.

15. The method of claim 12, wherein the abrasive is ceria.

16. The method of claim 13, further comprising the step of:

l) creating a plurality of conduits through the cured powder material to facilitate the distribution of fluids through the polishing article to the working surface.

17. The method of claim 13, further comprising the step of:

l) creating a plurality of grooves in the working surface of the polishing article.

18. The method of claim 17, wherein the grooves are formed in the working surface of the polishing article after curing.

19. The method of claim 17, wherein to grooves are formed as a result of the shape of the mold during the curing step.

20. A method for manufacturing a homogenous fixed abrasive polishing article having a working surface, comprising the steps of:

a) mixing a resinous binder, a solvent, an abrasive material and a filler material together, wherein the filler material has a hardness less than 3 on the Mohs hardness scale, thereby creating a resin coated abrasive-filler material;

b) drying the resin coated abrasive-filler material;

c) grinding the resin coated abrasive-filler material;

d) sieving the resin coated abrasive-filler material thereby creating a powder material;

e) compressing the powder material in a mold; and f) curing the powder material.

21. The method of claim 20, further comprising the steps of:

g) removing the cured powder material from the mold; and h) applying an adhesive to a portion of the cured powder material for adhering the polishing article to a polishing platen.

22. The method of claim 20, wherein the filler material comprises talc.

23. The method of claim 20, wherein the abrasive is ceria.

24. The method of claim 21, further comprising the step of:

i) creating a plurality of conduits through the cured powder material to facilitate the distribution of fluids through the polishing article to the working surface.

25. The method of claim 21, further comprising the step of:

i) creating a plurality of grooves in the working surface of the polishing article.

26. The method of claim 25, wherein the grooves are formed in the working surface of the polishing article after curing.

27. The method of claim 25, wherein the grooves are formed as a result of the shape of the mold during the curing step.

28. The method of claim 21, wherein the step of curing the powder comprises applying heat.

29. The method of claim 28, wherein the step of curing the powder material by applying heat is performed simultaneously with the step of compressing the powder material.

* * * * *